US006115992A

United States Patent [19]

Bankuty et al.

[11] Patent Number: 6,115,992

[45] Date of Patent: Sep. 12, 2000

[54] APPARATUS AND METHOD FOR PRE-CAPPING CONTAINERS

[75] Inventors: Geza E. Bankuty, Bradenton; Nicholas J. Perazzo, Sarasota, both of Fla.

[73] Assignee: New England Machinery, Inc.

[21] Appl. No.: 09/159,152

[22] Filed: Sep. 23, 1998

Related U.S. Application Data

[60] Provisional application No. 60/079,357, Mar. 25, 1998.

[51] Int. Cl.[7] ..... B65B 7/28

[52] U.S. Cl. ..... 53/308; 53/317; 53/331.5

[58] Field of Search ..... 53/306, 308, 317, 53/331.5

[56] References Cited

U.S. PATENT DOCUMENTS

| | | | |
|---|---|---|---|
| Re. 32,237 | 9/1986 | Willingham | 53/314 |
| 3,242,632 | 3/1966 | Dimond | 53/317 |
| 3,253,388 | 5/1966 | Volker et al. | 53/303 |
| 3,408,788 | 11/1968 | Greck | 53/42 |
| 3,724,166 | 4/1973 | van der Meer | 53/334 |
| 3,874,147 | 4/1975 | Zetterberg | 53/314 |
| 3,986,323 | 10/1976 | Aidlin et al. | 53/314 |
| 4,205,502 | 6/1980 | Ahlers | 53/308 |
| 4,308,707 | 1/1982 | Willingham | 53/314 |
| 4,624,098 | 11/1986 | Trendel | 53/314 |
| 4,658,565 | 4/1987 | Westbrook | 53/331.5 |
| 4,663,913 | 5/1987 | Trendel | 53/314 |
| 5,012,630 | 5/1991 | Ingram et al. | 53/490 |
| 5,115,617 | 5/1992 | Lewis et al. | 53/306 |
| 5,218,811 | 6/1993 | LaPlante et al. | 53/331.5 |
| 5,437,140 | 8/1995 | Molinaro | 53/331.5 |

*Primary Examiner*—John Sipos
*Attorney, Agent, or Firm*—Pettis & Van Royen, P.A.

[57] ABSTRACT

An improved pre-capping machine and method for pre-capping containers that are advanced along a predetermined path by standard conveyor systems. The present invention pretightens caps, plugs, overcaps and other fitments to ensure that they are squarely placed on the containers, without damage to the containers, in preparation for their final closure. The apparatus comprises a spindle assembly, having a longitudinal spindle axis, that is connected to a frame for movement of the spindle assembly along the spindle axis. The spindle assembly comprises a cap gripper that is configured to hold a cap centered over the open end of a container so that axes through the cap, the open end of the container and the spindle assembly generally coincide. To place a cap on the container, the spindle is released for free movement along the spindle axis.

5 Claims, 8 Drawing Sheets

APPARATUS AND METHOD FOR PRE-CAPPING CONTAINERS

RELATED APPLICATION

This application is based on Provisional application Ser. No. 60/079,357 entitled APPARATUS AND METHOD FOR PRE-CAPPING CONTAINERS, filed Mar. 25, 1998.

BACKGROUND OF THE INVENTION

1. Field of the Invention

The present invention relates to an apparatus for placement of caps, plugs, overcaps and other fitments into contact with their containers. The apparatus will pretighten the caps, plugs, overcaps and other fitments to ensure that they are squarely placed on the containers in preparation for their final closure.

2. Description of the Prior Art

Bottle capping machines have been in existence for over twenty years. On most capping machines, the system for placing caps on containers prior to tightening comprises a chute that delivers caps into the path of the containers that are being fed into the capping machine. The cap is held at an angle so that the leading edge of the cap engages the open end of the containers stripping the cap from the delivery chute so that the caps rest on the open end of the container. The containers advance to a tightening station that rotates threaded caps to a predetermined torque or presses other fitments downwardly into the container for a friction fit. Frequently, caps do not settle squarely on the container opening so that when the caps are tightened they remain out of alignment and fail to seal to the container properly.

To correct the problem generated by caps that are off-center, capping machines usually apply a strong downward force on the caps to force the caps into alignment with the container. Such force frequently damages the thread of threaded containers or the mouths of the containers resulting in caps having a failed seal. Such failed seals can permit leakage and/or contamination of the product.

The addition of tamper evident seals to the open end of containers prior to the capping operation causes increased interference with the capping process and an increased number of failures beyond those which the industry already sustained prior to these new requirements. In the alternative, seals may be placed within the caps prior to the application of the caps to the containers. In either case, if the tamper evident seal is off-center, the material may become enmeshed in the cap and container threads or between the fitments and the container opening.

There is a need, therefore, for an apparatus that with a light pressure ensures that a container cap is placed squarely on the open end of a container. Such an apparatus will improve the efficiency of the capping process and reduce the number of failures.

SUMMARY OF THE INVENTION

The present invention relates to an apparatus for pre-capping containers prior to the final capping process. The apparatus may place threaded caps, plugs, overcaps, and other fitments on containers. Therefore, for ease of discussion, we will define a cap as including threaded caps, plugs, overcaps and other fitments. This apparatus may be used with most capping machines as a station prior to the final tightening of caps upon containers.

The apparatus comprises a frame and a column attached to the frame for rotation of the column about its longitudinal axis. At least one spindle assembly, having a longitudinal axis, is connected to the column for rotation of the spindle assembly about the column, for rotation of the spindle assembly about its generally vertical longitudinal axis and for slidable movement along the vertical spindle axis of the spindle assembly. The spindle assembly further comprises a means for gripping a cap, conveniently a cap gripper, for movement of the cap to and placement on a container. When the cap gripper grips the cap the spindle axis is generally parallel to the axis of the column and generally coincident with the vertical axis of the cap.

The apparatus further comprises a conveyor positioned adjacent to the frame for advancing a container along a predetermined path. A means for positioning the container is attached to the column for alignment of the vertical axis of the container opening with the spindle axis. When a cap is gripped by the spindle assembly, the vertical axis of the cap is generally aligned with the spindle axis and, therefore, with the vertical axis of the container opening.

The apparatus further comprises a generally circular spindle cam that is attached to the frame so that the axis of the column passes through the center point of the radius of the spindle cam. The spindle cam has a first, a second and a third upwardly facing surface with transitional surfaces therebetween. A cam follower is connected to the spindle assembly so that as the spindle assembly rotates about the vertical axis of the column, the cam follower engages, in sequence, the three cam surfaces. Without the engagement of the cam follower with the cam, the spindle assembly may move freely along its spindle axis between a first position and a second position. The downward movement of the spindle assembly is limited by the spindle cam and cam follower. When the cam follower engages the first cam surface, the cap gripper is vertically spaced apart from the container caps. Just before the cam follower moves down the first transitional surface, the spindle assembly is centered over a cap so that the vertical axes of the spindle assembly, the cap gripper, and the cap all coincide. The spindle assembly then moves down the first transitional surface so the cap gripper comes into contact with the cap and grips the cap for movement over a container whose axis is now centered under the axis of the cap and the spindle assembly. While the spindle assembly axis is generally coincident with the axis of the container, the cam follower abruptly drops down the second transitional surface and the spindle assembly freely moves downwardly so that the cap squarely engages the open end of the container. There is no pneumatic pressure applied to the spindle assembly, nor is there a downwardly facing cam surface to force the spindle assembly downward to the second, or lowest position. When the cam follower has reached and is moving along the third surface, the spindle head is free to move downwardly to the second position, but moves only as far as necessary to engage the cap with the container and apply a downward force that is created by the weight of the spindle assembly alone. Once the cap is partially attached to the container, the cap gripper is released from the cap and the cam follower rides up the third transitional surface to the first cam surface. Once the cam follower has reached the first cam surface, the cap gripper is spaced apart from the cap and the container is free to move along the predetermined path to the final capping station, where the caps are tightened to the final frictional resistance.

BRIEF DESCRIPTION OF THE DRAWINGS

A preferred embodiment of the apparatus of this invention will be disclosed in detail below in connection with the drawings in which.

Similar reference characters refer to similar parts throughout the several views of the drawings.

DESCRIPTION OF A PREFERRED EMBODIMENT

Figure 1:
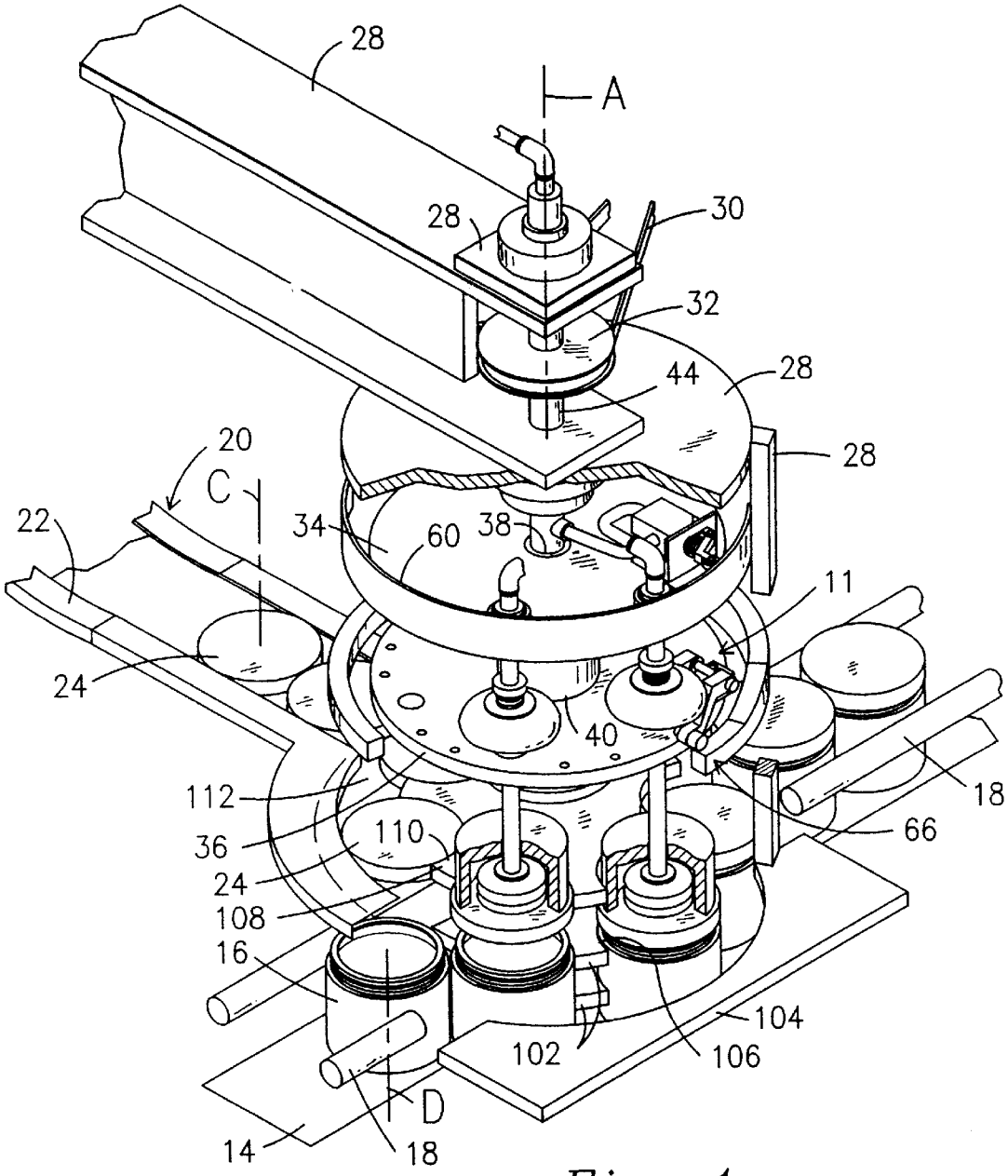
FIG. 1 is an isometric view of the apparatus of this invention.

A preferred embodiment of the apparatus and the method of this invention is illustrated in FIGS. 1–8, and such apparatus is used in working relationship with other, related devices that may include, for example, a conventional capping machine. In this application, a cap is defined to include threaded caps, overcaps, plugs, and other fitments. The precapping apparatus 10 comprises a turret assembly 11 that has at least one spindle assembly 12, but in the embodiment illustrated in the Figures, six spindle assemblies 12 have been shown, as it is an efficient configuration. The apparatus, 10 further comprises a conveyor 14 that moves containers 16 to the turret assembly 11 between two guide rails 18 and a cap delivery system 20, which is well known in the art. The cap delivery system 20 has a chute 22 that delivers caps 24 to the turret assembly 11.

The turret assembly 11 comprises a column 26 and an apparatus axis that conveniently lies along the vertical axis A of column 26. The column 26 is rotatably mounted to a frame 28 for rotation about its axis A by a drive motor (not shown) that is connected to the column 26 by a belt 30 passing around pulley 32 and a pulley (not shown) attached to the motor. The turret assembly 11 further comprises a first circular support plate 34 and a second circular support plate 36 that each have a central axis extending therethrough and holes 38 and 40 respectively formed and centered on these axes. The first and second support plates 34 and 36 respectively are then mounted to the column 26 so that the column projects through the holes 38 and 40 and the support plates rotate with the column. The support plates 34 and 36 are generally horizontal and are spaced apart from one another.

Figure 4:
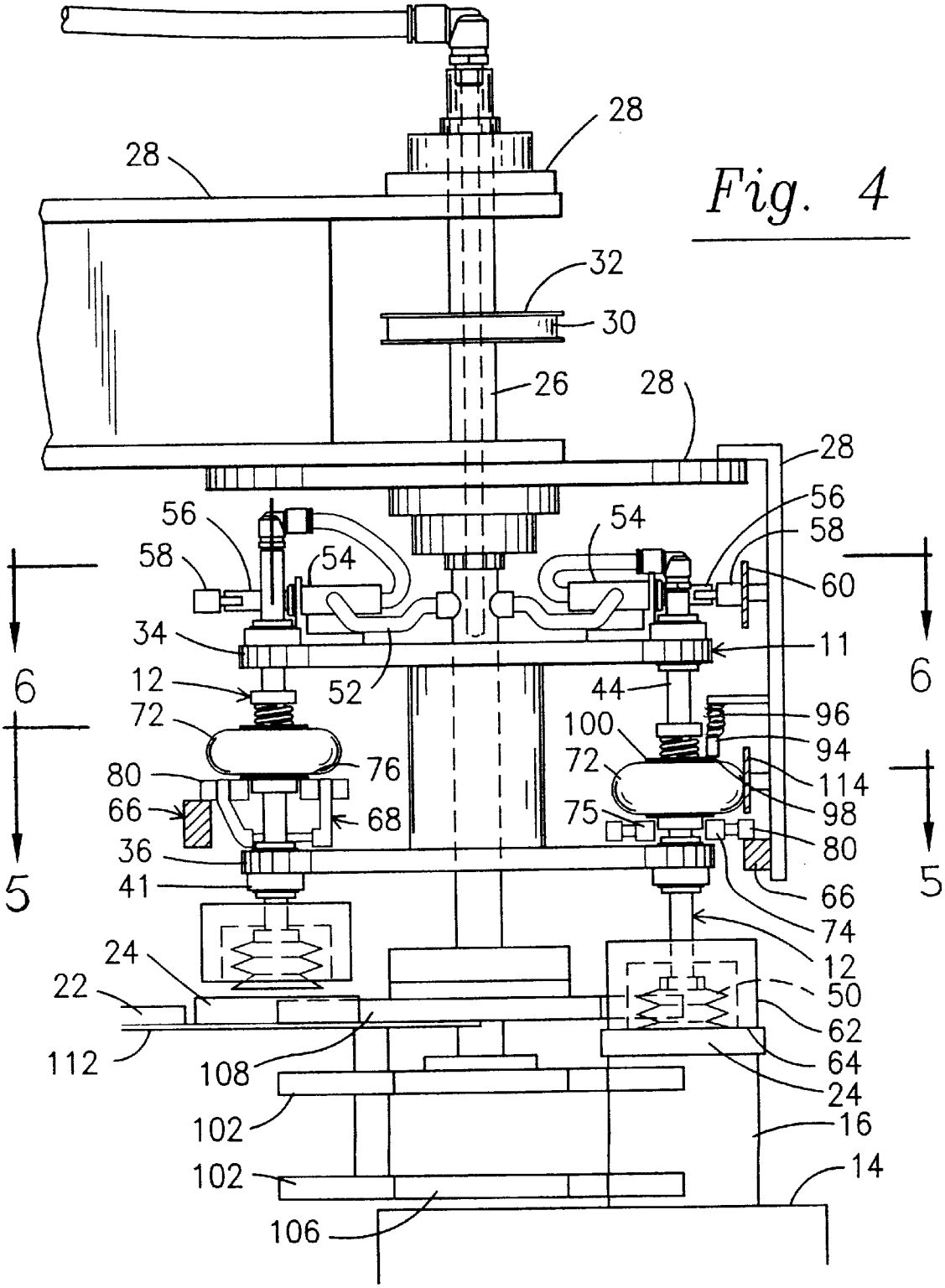
FIG. 4 is a detailed left side elevational view of the apparatus of FIG. 1 with a number of the spindle assemblies removed for clarity.
Figure 5:
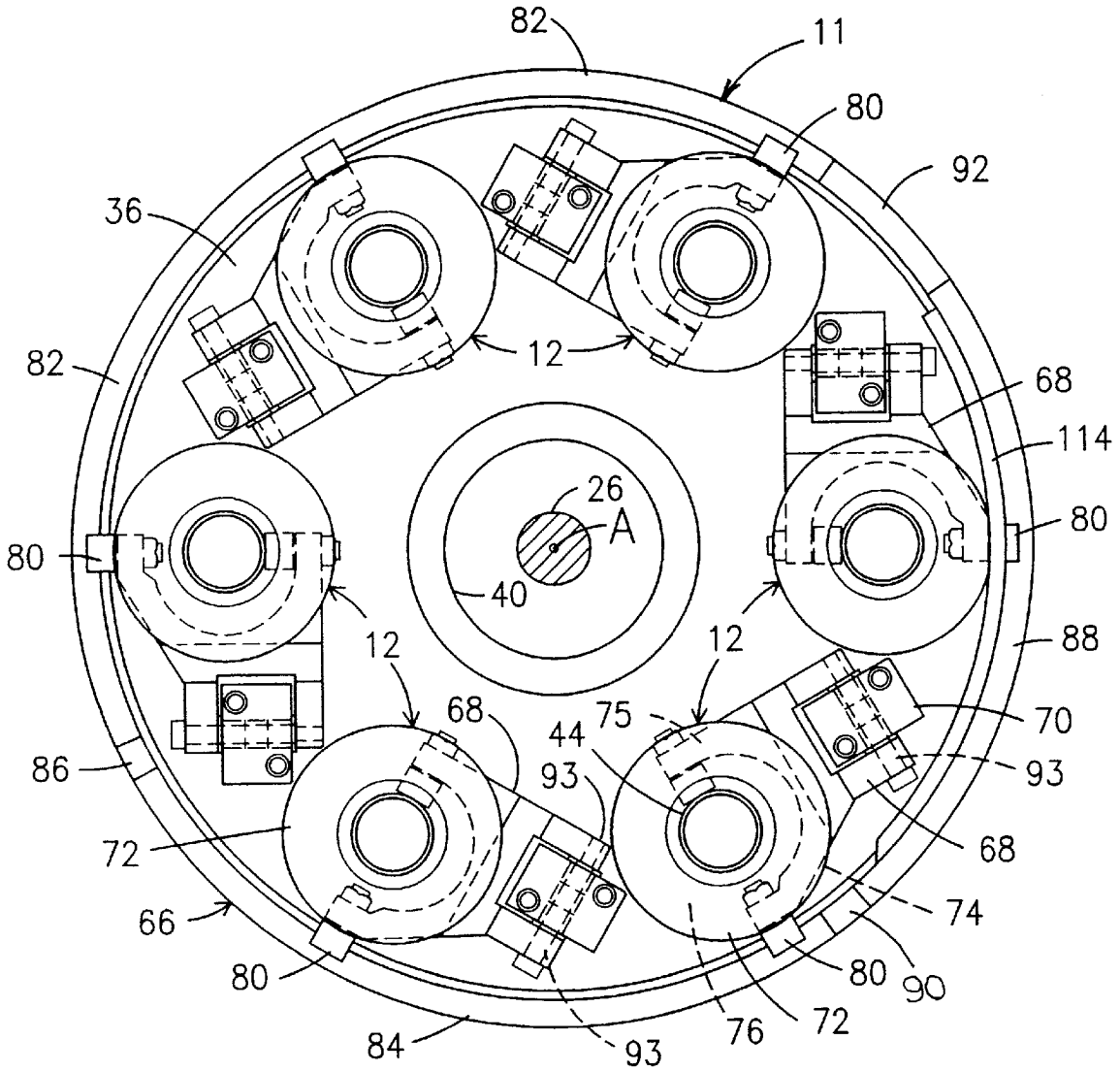
FIG. 5 is a cross sectional view taken along lines 5—5 of FIG. 4, illustrating a portion of all spindle assemblies.
Figure 6:
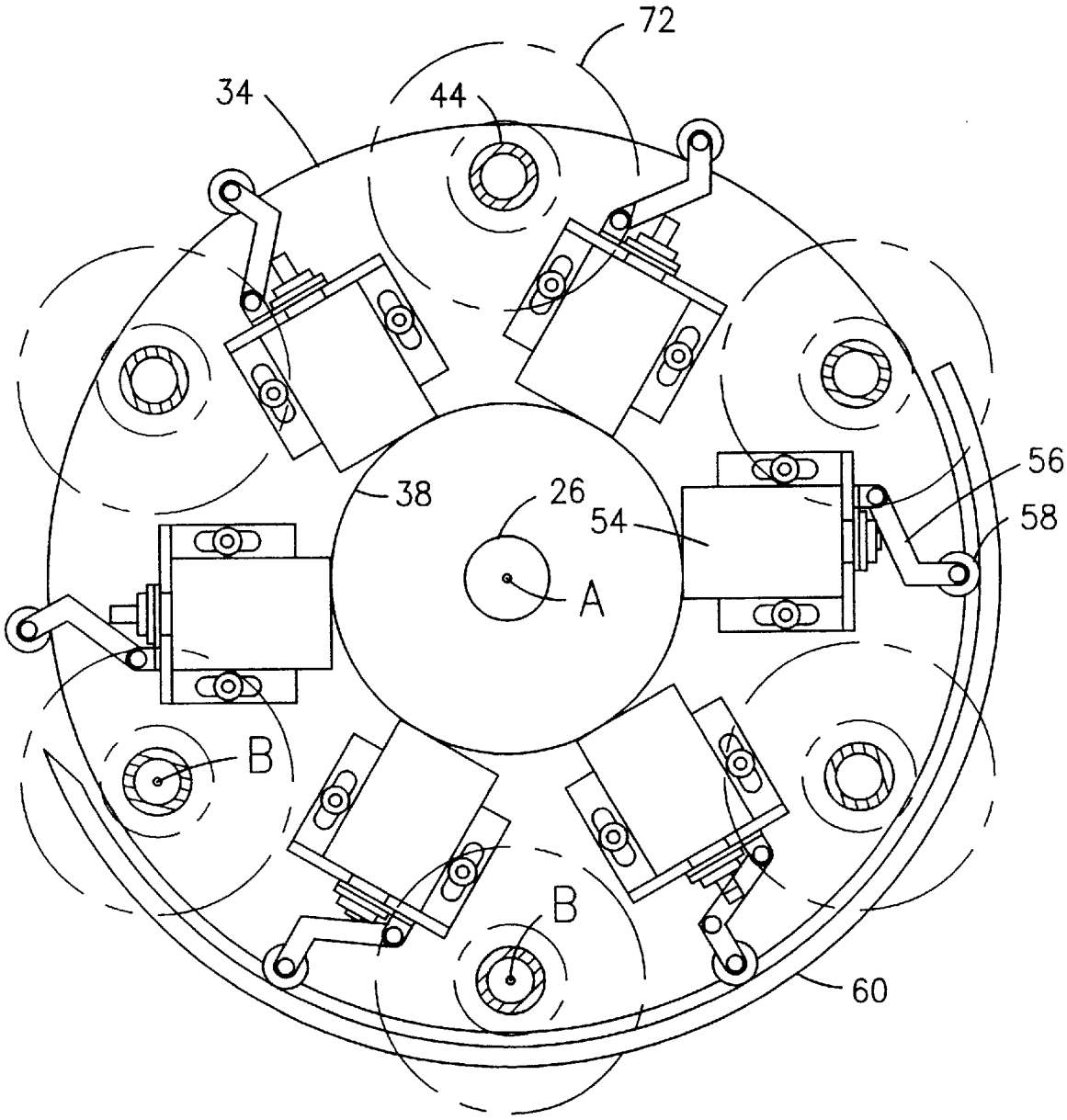
FIG. 6 is a cross sectional view taken along lines 6—6 of FIG. 4, illustrating portions of all spindle assemblies.

As seen in FIGS. 4 and 5, six spindle assemblies 12 are each mounted to the second support plate 36 by a linear bearing 41, for vertical movement and rotational movement of the spindle assembly in relation to the second support plate 36. As can be seen in FIG. 1, the same spindle assemblies 12 are also mounted to the first support plate 34 by bearings 42 for rotation and vertical movement of the spindle assemblies 12 in relation to the first support plate 34.

Figure 3:
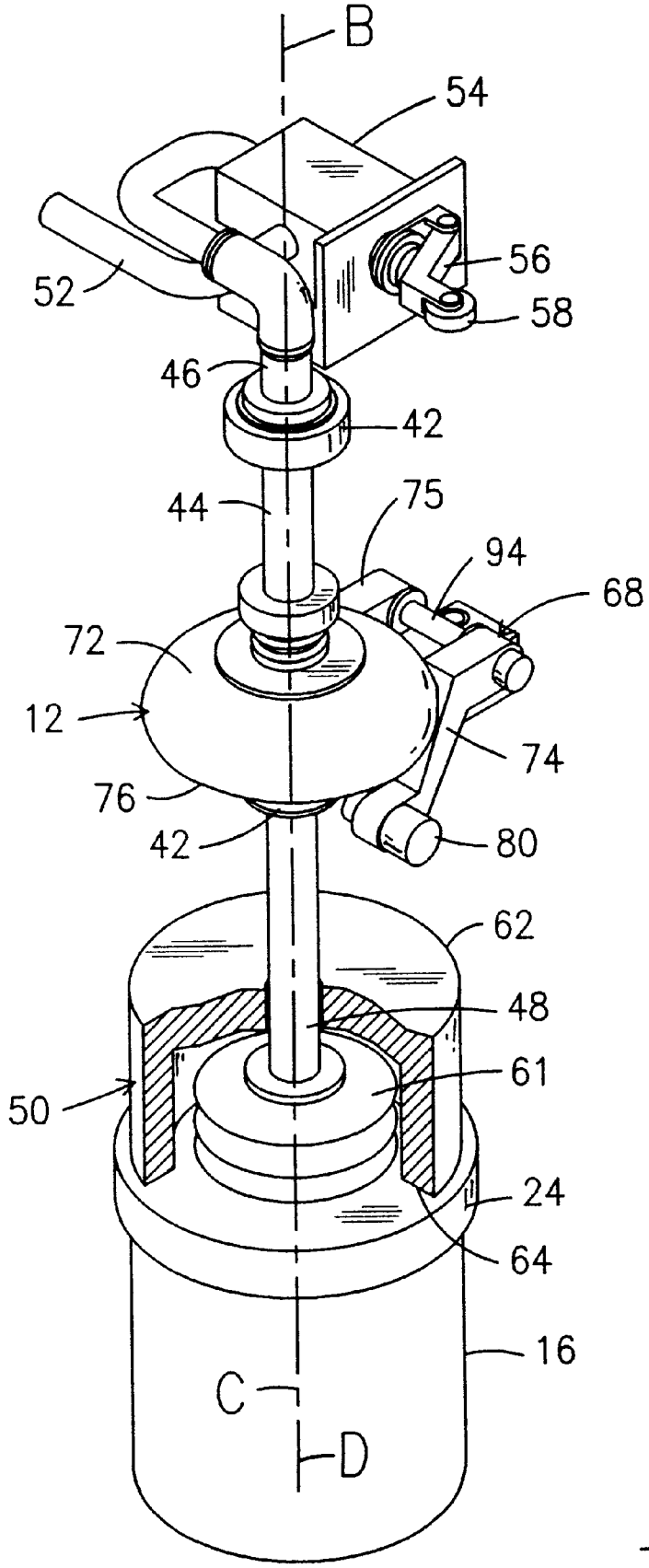
FIG. 3 is a detailed isometric view of the spindle assembly of this invention.

As most clearly seen in FIG. 3, the spindle assembly 12 comprises a spindle 44 having a first end 46 and a second end 48. To the second end 48 is attached a means for gripping the cap 24, conveniently a cap gripper, 50. The spindle 44 is hollow and at the first end 46, it is attached to a pipe 52 which is connected to a suction means (not shown). Attached to the pipe is a contact switch 54 having an arm 56 with a cam roller 58 attached thereto. The roller engages a vertical cam surface 60, which is most clearly seen in FIG. 6 but is also visible in FIGS. 1 and 4. The vertical cam surface 60 is positioned so that the cam roller 58 engages the vertical cam surface 60 when the cap gripper 50 engages the cap 24 and suction is applied to hold the cap 24 to the spindle assembly 12. The arm 56 is pressed against the switch 54 that opens the valve to permit a suction to be taken through the spindle 44. The cap gripper 50 comprises a suction cup 61 and a suction cup cover 62 that is attached to the spindle 44 and is sized so that its bottom surface 64 engages the cap 24 when suction is applied to the suction cup 61. The cover 62 stabilizes the cap and holds the cap in a generally horizontal plane while it is held by the suction cup 61. For plugs, overcaps, and other fitments the cap gripper 50 will be designed and constructed in an appropriate manner that is well known in the art.

Figure 8:
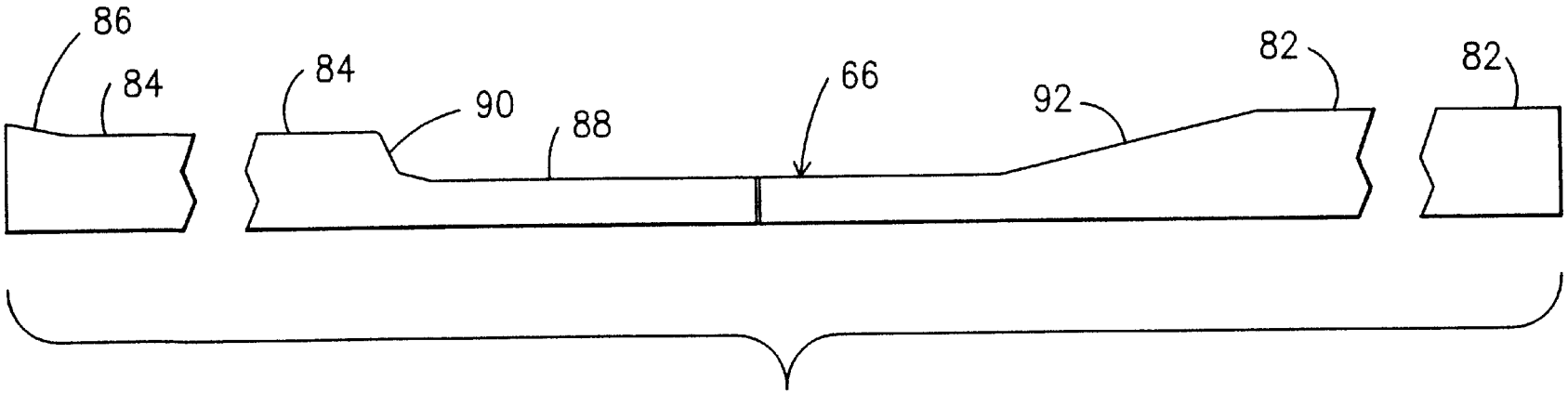
FIG. 8 is a flattened view of the spindle cam illustrating the pattern of the spindle cam surfaces.

The vertical movement of each spindle assembly 12 is partially controlled by an upwardly facing spindle cam 66, which is best seen in FIG. 8 and FIG. 1 where a portion is broken away for clarity. The spindle cam 66 is mounted to the frame 28 and completely encircles but is spaced apart from support plate 36 and the center of the radius of the spindle cam 66 lies on the axis A. As seen in FIG. 5, a U-shaped member 68 is pivotally mounted by a bracket 70 to the support plate 36. A wheel 72 is mounted to the spindle 44 for rotation with the spindle 44. The U-shaped member 68 extends under the wheel 72 so that the legs 74 and 75 engage the bottom surface 76 of the wheel 72. Attached to the first end 77 of leg 74 of U-shaped member 68 is a cam follower 80 that engages the spindle cam 66.

The spindle cam 66 has three separate upwardly facing surfaces that are separated by three transitional surfaces. As seen in FIG. 5 and FIG. 8, the first cam surface 82 is connected to the second cam surface 84 by transitional surface 86. The second cam surface 84 is connected to the third cam surface 88 by transitional surface 90. Cam surface 88 is connected to cam surface 82 by transitional surface 92. As the turret assembly 11 rotates about the column, the cam follower 80 rides upon the spindle cam 66 raising and lowering the spindle 44. When the cam follower 80 is moved upwardly by the spindle cam 66, the U-shaped member 68 pivots about the pins 93 held by the bracket 70 and each leg 74 and 75 pushes upwardly on the bottom surface 76 of the wheel 72.

As seen in FIG. 4, a pressure plate 94 is mounted by springs 96 to the frame 28. The bottom surface 98 of the pressure plate 94 engages a disc 100 that is attached to the wheel 72. This permits additional pressure to be applied downwardly on the spindle assembly 12 if needed. By mounting the pressure plate 94 with adjustable springs 96, variable pressures may be applied.

Figure 7:
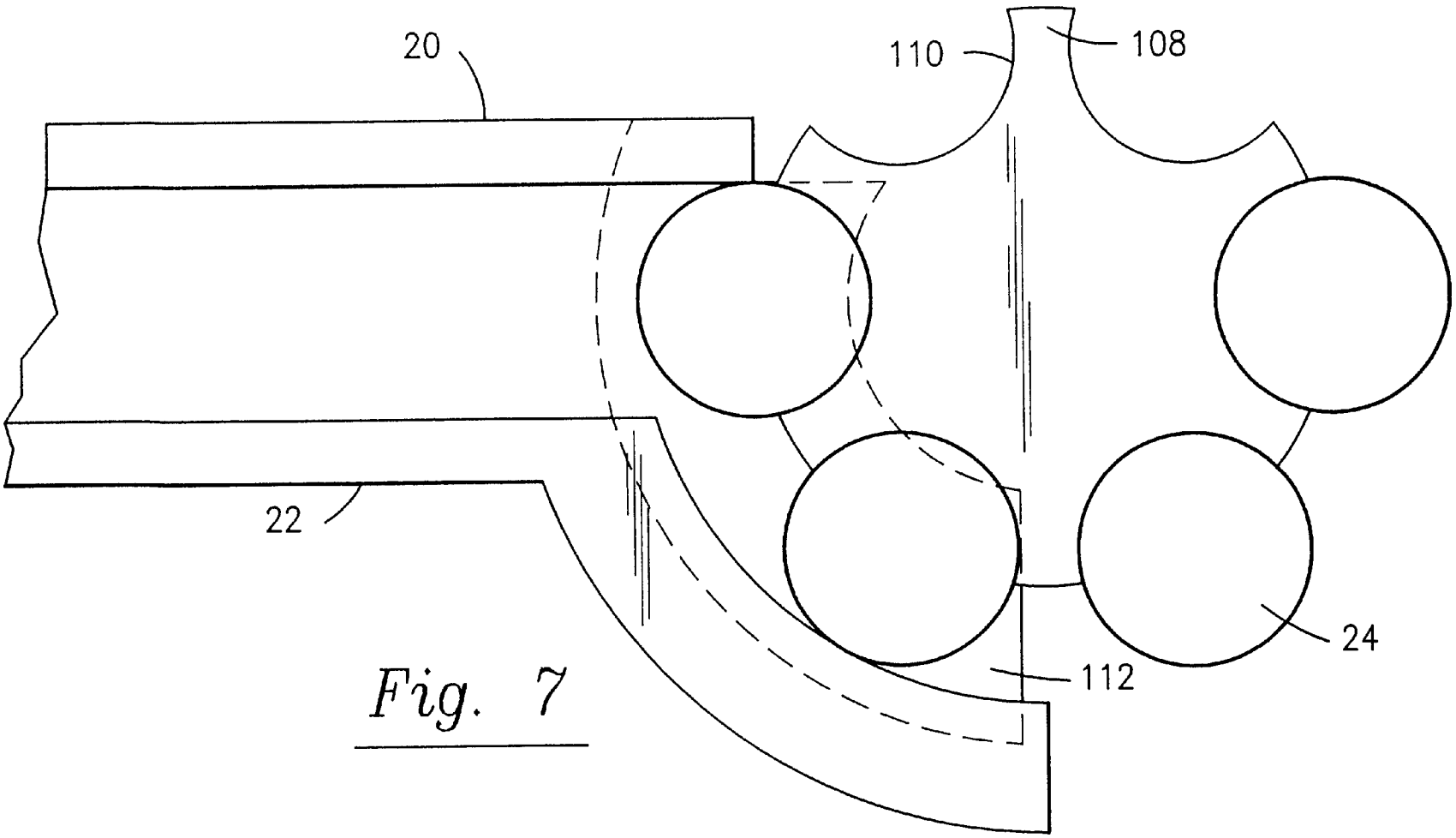
FIG. 7 is a detailed view of the cap delivery system of FIG. 1.

The movement of the containers 16 about their predetermined path on the conveyor 14 is controlled by a container guide mechanism, conveniently star wheel 102 and a guide member 104 that keeps the containers snugly within the pockets 106 formed in the star wheel 102. As seen in FIG. 7, cap star wheel 108 has pockets 110 formed therein to receive the caps 24 and hold them so that the caps are axially aligned with the axis of the spindle assembly 12. The caps 24 are pushed down the chute 22 of the cap delivery system by gravity so that the pressure of the caps above push the caps 24 into the pocket 110. Proximal to the end of the chute 20 is a dead plate 112 that extends below the pockets 110 to support the cap 24 before it is gripped by the cap gripper 50. The dead plate 112 is seen more clearly in FIG. 7.

Figure 2:
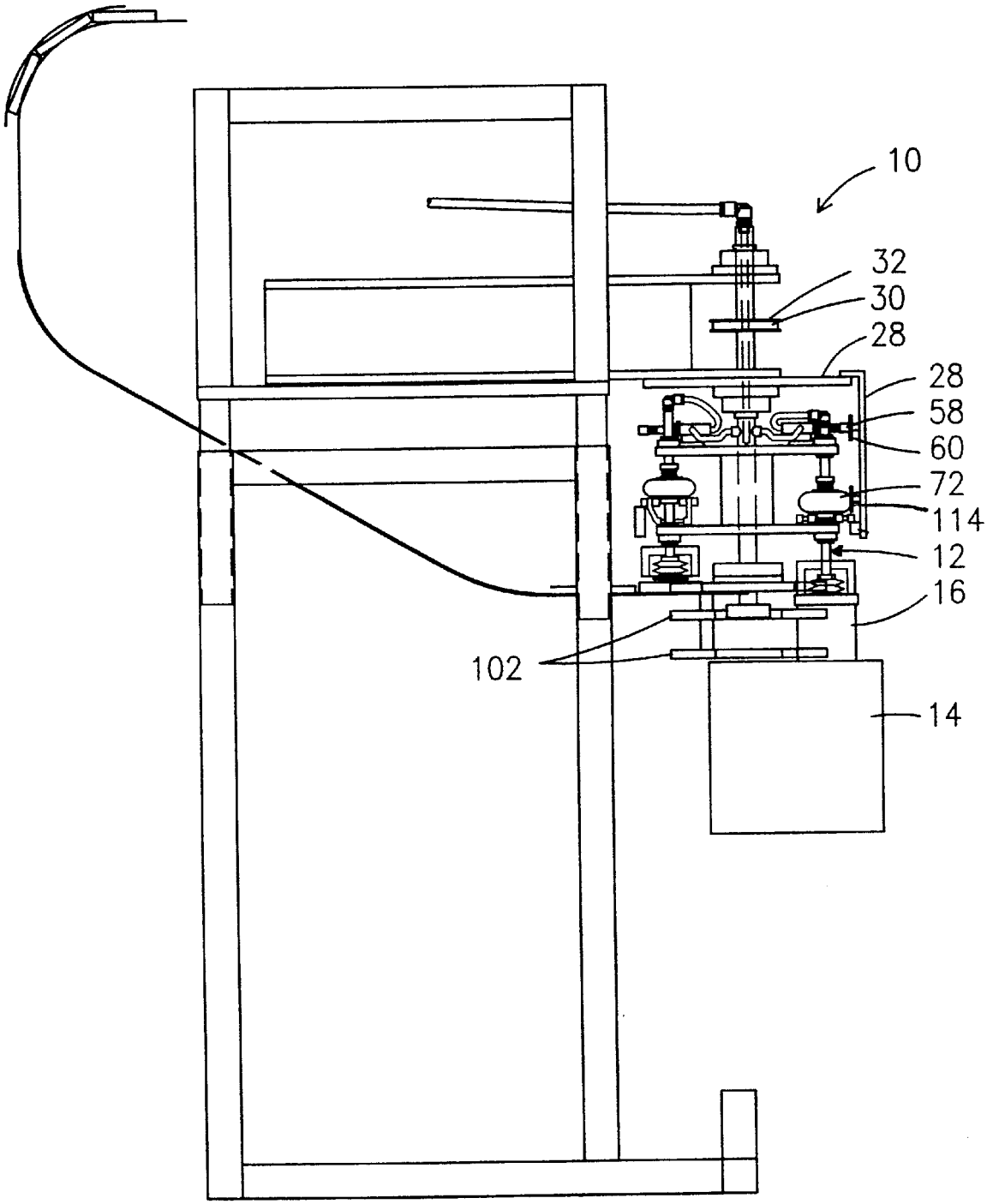
FIG. 2 is a left side elevational view of the apparatus of this invention with a number of the spindle assemblies removed for clarity.

As seen in FIG. 2, rotation plate 114 is attached to the frame 28 to engage wheel 72 through a portion of the rotation of the turret 11. When the wheel 72 engages the rotation plate 114, the wheel rotates causing the spindle 44 to rotate and, thus, rotating the cap 24 approximately one-half to one turn so that on a threaded cap, the threads of the cap 24 may engage the threads on the container 16.

Having thus set forth a preferred construction for the apparatus 10 of this invention, it is to be remembered that this is but a preferred embodiment. Attention is now invited to a description of the operation of the apparatus 10. The apparatus in FIGS. 1–8 illustrate a preferred embodiment of an apparatus that applies threaded caps; however, as mentioned previously, the device may be used to place plugs, overcaps, and other fitments on containers. When using other container closure devices, changes in the cap delivery system 20, the cap star wheel 108 and the cap gripper 50 would be made to accommodate the particular shape and size of these different container closures, modifications that would be obvious to those skilled in the art. Therefore, describing the example of threaded caps, a supply of caps 24 are inserted within the cap delivery system 20 and containers 16 are placed upon the conveyor system with the product therein. The turret 11 continuously rotates as the caps and containers are fed into the apparatus 10. A cap 24 is pushed into a pocket 110 of the cap star wheel 108 by the weight of neighboring caps. As soon as the cap 24 is received in its pocket 110, the cam follower 80 of the adjacent spindle assembly 12 moves down the transition cam surface 86 of the upwardly facing cam 66 to ride along cam surface 84. This places the suction cup 61 into contact with the cap 24 and almost simultaneously the cam roller 58 engages the vertical cam surface 60 pressing the contact switch 54 so that suction is taken on the suction cup 50. The cap 24 is now gripped by the spindle assembly 12 and is rotated past the dead plate 112 so that the cap 24 is now directly aligned over a container 16 that has been received within the container star wheel 102. The guide member 104 ensures that the container 16 is inserted within the pocket 106 of the container star wheel 102. The spindle assembly 12 is now axially aligned with the cap 24 and the container 16. The cam follower 80 now engages the second transitional cam surface 90 so that the spindle assembly 12 drops freely downward by the weight of gravity to engage the container 16. The amount of drop permitted by the second transitional surface 90 exceeds the maximum distance that the spindle is ever required to drop to engage a cap 24 with a container 16. This means that the spindle is free to float so that the cap threads may engage the container threads at any point without damaging the threads. The location of the lead portion of the threads, both on the caps 24 and the containers 16, determine the total distance a spindle drops before the lead portions of the cap 24 and container 16 threads make first engagement. Many caps 24 have threads that are closer to the top surface of the cap than to the open end of the cap requiring that the spindle drop further in order to make the first engagement of the threads with one another. To prevent damage to the container, the container opening and/or the threads, it is solely the weight of the spindle that creates the light downward force. When threaded caps and containers are used, the wheel 72 engages the rotation plate 114 rotating the spindle one-half to one turn so that the cap 24 is lightly attached to the container 16.

Once the threads engage one another, the cam roller 58 reaches to the end of the vertical cam 60 opening the contact switch 54 and opening the suction cup 61 to atmosphere so that the suction cup 61 is no longer attached to the cap 24. The cam follower 80 then engages the third transitional surface 92 raising the spindle to the first position, the highest position, where the cam follower 80 engages the first cam surface 82. The partially capped containers 16 are now free to travel down the conveyor 14 to a capper which will complete the closure of the containers to a predetermined resistance level.

A method for pre-capping containers will now be described. Placing a cap 24, having a vertical axis C, adjacent to a spindle assembly 12 so that the cap is horizontally oriented and its axis C is vertical. Capturing the cap 24 by a gripping means that is attached to the spindle assembly 12 so that the caps vertical axis C is coincident with the axis B of the spindle assembly 12. Rotating the cap about a central axis A until the cap 24 is in vertical alignment with a container 16 and the axis C of the cap is coincident with the vertical axis D of the container. When the spindle assembly and the cap and the container are all axially aligned, freeing the spindle assembly 12 to move downwardly only under the weight of the spindle assembly, so that the spindle assembly 12 moves between a first position and a second position, which establishes the highest and lowest points respectively in the movement of spindle assembly 12. Placing the cap 24 on the container 16 by the downward movement of the spindle assembly 12. Arresting the downward movement of the spindle assembly 12 by engagement of the cap 24 with the container 16 so that the spindle assembly does not reach the second position. The apparatus is constructed so that the spindle assembly 12 never reaches the second position as the cap will engage the container before the second position can be reached. This permits the spindle assembly to move freely upwardly and downwardly as there is no downwardly facing spindle cam to restrict or control the movement of the cam follower 80 in the upward direction. If the cap has threads thereon, a one-half to one full turn is made to make a preliminary engagement of the cap threads with the container threads. If plugs or other fitments are used, the downward pressure is sufficient to properly seat these fitments within the container opening. There is no pneumatic pressure applied to force the spindle assembly downwardly; it moves solely under its own weight so that a light force is applied. If additional force is necessary, a pressure plate, which may be spring loaded for adjustment purposes, is used to engage the pressure plate 94 of the wheel 72 spindle assembly for further controlled downward pressure. The last step comprises moving the container 16 to a capping machine where the cap 24 is tightened to a container at a predetermined torque.

It will thus be seen that the objects set forth above, among those made apparent from the preceding description, are efficiently attained, and, since certain changes may be made in the above article without departing from the scope of the invention, it is intended that all matter contained in the above description or shown in the accompanying drawings shall be interpreted as illustrative and not in a limiting sense.

What is claimed:

1. An apparatus for placement of caps on openings of containers, comprising:

a frame;

a conveyor positioned adjacent said frame for advancing a container along a predetermined path, the container having an opening and a generally vertical axis extending through the center of said opening;

a spindle assembly having a longitudinal axis, said spindle assembly being connected to said frame for movement along said longitudinal axis of said spindle assembly between a first position and a second position;

a container guide mechanism connected to said frame for guiding a container so that the container axis generally coincides with said axis of said spindle assembly;

a cap delivery system for delivering a cap to said spindle assembly such that when a cap is delivered the vertical axis of the cap generally coincides with said spindle assembly axis;

a cap gripper attached to said spindle assembly such that when said cap gripper grips a cap delivered by said cap delivery system the vertical axes of the cap, the container and said spindle assembly are generally coincident when said spindle assembly overlies the container; and means for controlling a portion of the movement of said spindle assembly along said longitudinal axis of said spindle assembly by holding said spindle assembly in said first position until a cap is axially aligned under said cap gripper by said cap delivery system, then moving said spindle to a third position, intermediate said first and second positions, where a cap is gripped by said cap gripper, and then releasing said spindle to fall freely until the cap engages the open end of a container before said spindle reaches said second position.

2. An apparatus as in claim 1 wherein;

said apparatus further comprises a column being mounted to said frame, said column having a longitudinal axis, and said spindle assembly moving about said axis of said column;

said means for controlling a portion of the movement of said spindle assembly comprises, an upwardly facing spindle cam attached to said frame having a first and a second upwardly facing cam surface; and a cam follower connected to said spindle assembly and engaging said upwardly facing cam surface as said spindle assembly moves about said column, such that when said cam follower engages said first cam surface said spindle assembly is maintained in said first position, when said cam follower engages said second cam surface said spindle assembly is in said third position and when said cam follower is no longer supported by said second cam surface said spindle assembly is free to fall downwardly toward said second position until a cap, when held by said cap gripper, engages a container before said spindle assembly reaches said second position.

3. An apparatus as in claim 2 wherein said spindle assembly when released by disengagement of said cam follower from said spindle cam being free to move upwardly.

4. A method for pre-capping containers, comprising the steps of:

advancing a container along a predetermined path, the container having an opening and a generally vertical axis extending through the center of said opening;

guiding said container under a spindle assembly so that said axis passing through said opening in said container generally coincides with a longitudinal axis extending through said spindle assembly;

delivering a cap adjacent to said spindle assembly such that a vertical axis passing through said cap generally coincides with said spindle assembly axis;

moving said spindle assembly along said spindle assembly longitudinal axis until a cap gripper attached thereto engages said cap;

gripping said cap with said cap gripper so that the vertical axes of said cap, said container and said spindle assembly are generally coincident; and releasing said spindle to fall freely until said cap engages the open end of said container.

5. A method for pre-capping containers as in claim 4 comprising the further step of:

rotating said spindle assembly and the cap held by said cap gripper so that when a threaded cap engages said opening in said container and said container opening is threaded, said threads of said cap engage the threads of said container.

* * * * *